US006035840A

United States Patent [19]

McPherson

[11] Patent Number: 6,035,840

[45] Date of Patent: Mar. 14, 2000

[54] CAM

[76] Inventor: Mathew A. McPherson, Box 1075, Norwalk, Wis. 54648

[21] Appl. No.: 09/032,603

[22] Filed: Feb. 27, 1998

Related U.S. Application Data

[62] Division of application No. 08/772,360, Dec. 23, 1996, Pat. No. 5,809,982.

[51] Int. Cl.[7] ..... F41B 5/10

[52] U.S. Cl. ..... 124/25.6

[58] Field of Search ..... 124/25.6, 900

[56] References Cited

U.S. PATENT DOCUMENTS

| | | | |
|---|---|---|---|
| D. 331,614 | 12/1992 | Martin et al. | D22/107 |
| 4,078,537 | 3/1978 | Carella . | |
| 4,287,868 | 9/1981 | Schiff | 123/44.5 |
| 4,401,097 | 8/1983 | Simonds et al. . | |
| 4,438,753 | 3/1984 | Simonds . | |
| 4,461,267 | 7/1984 | Simonds et al. . | |
| 4,478,203 | 10/1984 | Hayes . | |
| 4,512,326 | 4/1985 | Jarrett . | |
| 4,660,536 | 4/1987 | McPherson . | |
| 4,993,399 | 2/1991 | Chattin | 124/25.6 |
| 5,147,248 | 9/1992 | Lewis et al. | 474/166 |
| 5,174,268 | 12/1992 | Martin et al. | 124/25.6 |
| 5,368,006 | 11/1994 | McPherson | 124/25.6 |
| 5,499,618 | 3/1996 | Thompson | 124/25.6 |
| 5,505,185 | 4/1996 | Miller | 124/25.6 |

OTHER PUBLICATIONS

Dynabo (Models M–10 Cheetah & Jim Cox Magnum) Instruction Manual Excerpt, mid–1970's.

Kam–Act "MK–2" Instruction Manual Excerpt, early–1970's.

Kam–Act Instruction Manual Excerpt for Martin Archery, Inc., "New for '74'", mid–1970's.

Bow & Arrow publication of Apr. 1980.

bow & Arrow publication Dec. 1975.

Advertising from Allen, The Original Compound Bow, Dec. 1975.

*Primary Examiner*—John A. Ricci

*Attorney, Agent, or Firm*—Vidas, Arrett & Steinkraus, P.A.

[57] ABSTRACT

An inventive cam body which includes a counteracting weight which generates a net counteracting centrifugal force to act against the forward force of the bow.

19 Claims, 9 Drawing Sheets

10
12
14
16
18
20
22
24
26
28
29

SHORT LIMB
STRAIGHT HANDLE
AXLE HEIGHT
BRACE HEIGHT
5
8
76
72
82
84
86
78
88
α

LONG LIMB
REFLEX HANDLE
AXLE HEIGHT
BRACE HEIGHT
5
8
74
70
80
86
78
88
α

LONG LIMB
STRAIGHT HANDLE
AXLE HEIGHT
BRACE HEIGHT
7
8
68
66
60
62
64
β
PRIOR ART

CAM

CROSS REFERENCES TO RELATED APPLICATIONS

This application is a divisional application of Ser. No. 08/772,360 filed Dec. 23, 1996 now U.S. Pat. No. 5,809,982, the entire contents of which are hereby incorporated by reference.

BACKGROUND OF THE INVENTION

The present invention relates to a counteracting weight for a cam or pulley for use with a compound bow. More specifically, rotation of the cam or pulley back from the fully drawn position to the rest position generates a counteracting centrifugal force to the forward force of the bow.

As the bowstring is drawn in a compound bow, the bow limbs flex to store energy. When the bowstring is released the bow limbs unflex and the bowstring returns to the rest position. The unflexing of the bow limbs and the forward movement of the string create a forward force on the bow, which is transmitted to the user through the arm holding the bow.

Because the user grips the bow below the arrow, the upper portion of the bow, more particularly the upper bow limb kicks back slightly toward the archer. This is called kick-back.

The release of the bowstring and return of the bow to the rest position also causes the bow to vibrate, with the vibration being transmitted to the user through the arm holding the bow.

The forward force of the bow, kick-back and vibration are all undesirable. What is needed is something to reduce the forward force of the bow, kickback and vibration.

BRIEF SUMMARY OF THE INVENTION

By adding a counteracting weight to one or both rotating members on the compound bow the forward force of the bow, kick-back and vibration are all reduced. In addition the velocity of the arrow discharged is increased. In the preferred embodiment a tungsten weight is incorporated into one or both of the rotating members and positioned on the inside or handle side of the bow when the bow is at rest. As the bow is drawn the rotating members rotate from the rest position to the drawn position, and the tungsten weight rotates from inside the bow to outside the bow. When the bowstring is released the tungsten weight rotates back such that when the rotating member reaches rest a counteracting centrifugal force is generated which acts against the forward force of the bow. Applicants have discovered that in addition to reducing the forward force of the bow and lowering vibration, the velocity of the arrow is surprisingly increased between approximately 1–3 feet/second as compared to the same bow without the counteracting weight.

The rotating member can either be a cam or a pulley and therefore the invention can be utilized on any type of compound bow, either of the dual cam or single cam type. If the counteracting weight is only used on the cam at the lower end of the bow, the counteracting weight will only be generated at the lower end of the bow, which in addition to reducing the forward force of the bow and bow vibration, will also reduce upper limb bow kick-back. If counteracting weights are utilized on both the lower and upper rotating members, kick-back can be reduced by ensuring that a greater counteracting force is generated by the lower rotating member. This can be ensured either through weight differential on the weights utilized in connection with the two rotating members, or different positioning of the weights on the rotating members.

Although the preferred embodiment utilizes a fixed tungsten weight incorporated into the rotating member, any arrangement whether fixed or movable which generates the appropriate counteracting centrifugal force will work. Specific alternate embodiments to a fixed weight discussed below include incorporating a chamber inside the cam which has tungsten bearings in an oil bath which move as the rotating member rotates to generate the appropriate counteracting centrifugal force. Another embodiment incorporates a swinging weighted arm and spring arrangement which generates the appropriate counteracting centrifugal force. Yet another alternate embodiment incorporates a weight and spring arrangement in a chamber which generates the appropriate counteracting centrifugal force.

In addition to the counteracting weight, applicant has invented an improved elliptically shaped cam constructed so that the bowstring contact point is moved both back toward the archer and inward toward the handle as compared to prior art cams. Applicant has found that if the sum of the two sides of a right triangle formed by the bowstring contact point and the cam rotation point is greater than three inches the cam will store more energy in the first 4–5 inches of draw, which results in an increase in the speed of the arrow by 2–6 feet per second. Moving the bowstring contact point inward toward the handle also results in a shorter effective bowstring length, which decreases forward string whip. This unique cam construction also preferably has a lever ratio of between 1–3, as compared to a lever ratio typically of about 5 in prior art elliptically shaped cams. A lower lever ratio results in a quieter shot since the bowstring is under less tension at rest.

BRIEF DESCRIPTION OF THE DRAWINGS

A detailed description of the invention is described below with specific reference being made to the drawings, in which.

DETAILED DESCRIPTION OF THE INVENTION

Figures 1, 2, 3:
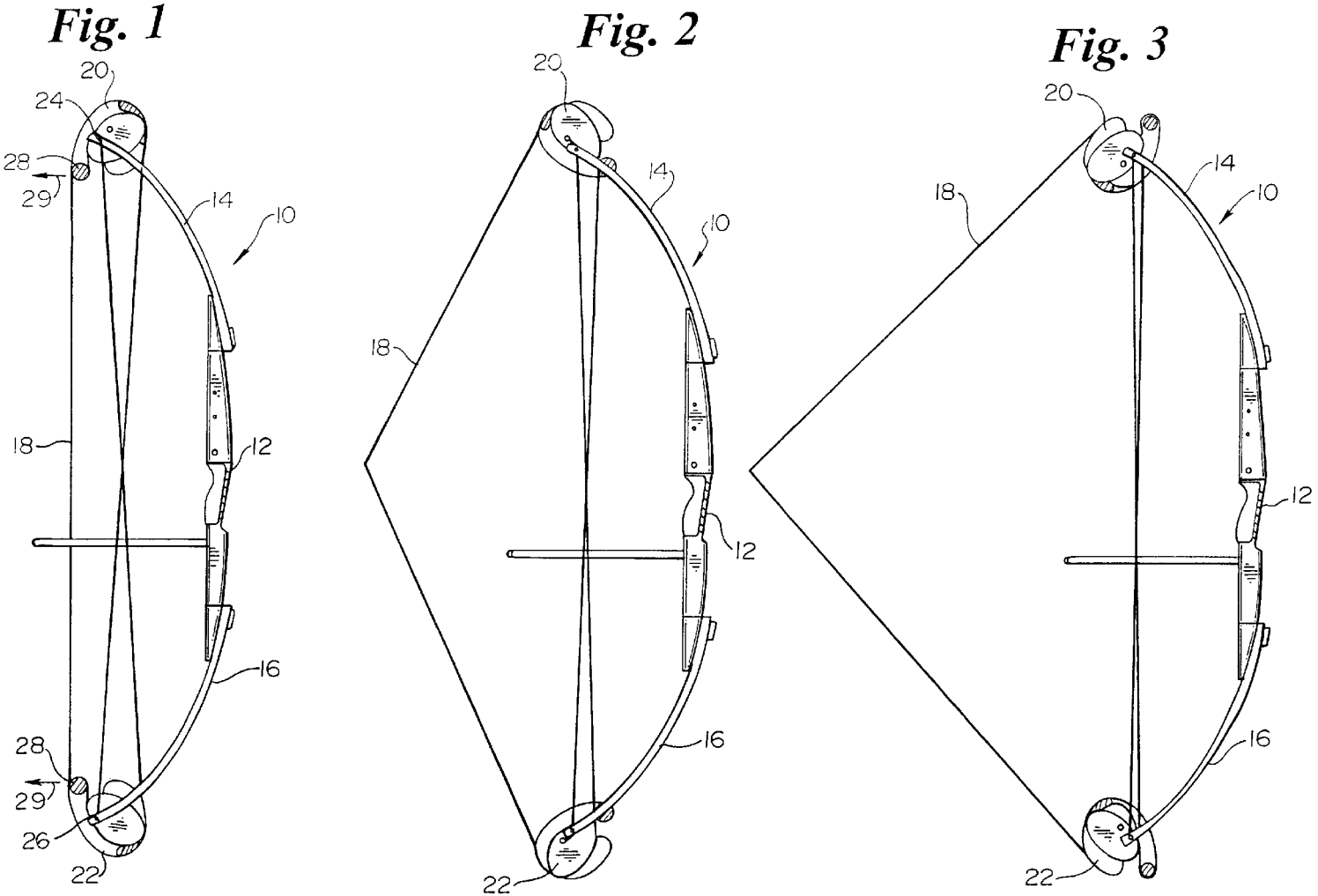
FIG. 1 shows a side view of a 2 cam bow embodying the inventive counteracting weight in the rest position.
FIG. 2 shows a side view of a 2 cam bow embodying the inventive counteracting weight in a partially drawn position.
FIG. 3 shows a side view of a 2 cam bow embodying the inventive counteracting weight in the fully drawn position.

While this invention may be embodied in many different forms, there are shown in the drawings and described in detail herein a specific preferred embodiment of the invention. The present disclosure is an exemplification of the principles of the invention and is not intended to limit the invention to the particular embodiment illustrated.

FIGS. 1–3 show an archery bow, shown generally at 10, which includes a central handle 12 which connect the inner ends of a pair of bow limbs 14 and 16. Applicant's previous issued patents U.S. Pat. Nos. 4,660,536 and 5,368,006 discuss archery bows and their entire contents are hereby incorporated by reference. As is well known in the field of archery, the bow limbs 14 and 16 provide the desired resistance to bending or flexing, which determines the draw weight of the bow and the force with which the arrow is discharged.

Bowstring 18 and cams 20 and 22 are shown in FIG. 1 in the rest position, in FIG. 2 in a partially drawn position and in FIG. 3 in the fully drawn position. As is well known in the field of archery the cams rotate about rotation point 24 and 26, which represents axle pins used to mount the cams to the outer end of the bow limbs 14 and 16. In the preferred 2 cam embodiment each cam is made of aluminum and includes a circular counteracting weight portion 28 made of tungsten, which has approximately 7 times the specific gravity of aluminum. In the preferred embodiment, circular counteracting weight portion 28 has a diameter of approximately ¾ inch and is approximately 3/16 inches thick. As seen in FIG. 1, counteracting weight portion 28 is positioned on each cam 20 and 22 so that at rest the weights are inside the bow. As the bowstring 18 is drawn, cams 20 and 22 rotate about their rotations points 24 and 26 and counteracting weight portions 28 move toward the inside surface of bow limbs 14 and 16, past bow limbs 14 and 16 (FIG. 2) and away from the outside surface of bow limbs 14 and 16 (FIG. 3). When the bowstring is released cams 20 and 22 rotate back to their rest positions shown in FIG. 1, and when the cams reach the rest position the counteracting weight portion 28 of cams 20 and 22 are moving in the opposite direction to the forward movement of the bowstring 18. Because counteracting weight portion 28 in cams 20 and 22 concentrates the weight of the cam in portion 28 of the cams, the weight of the cam portion moving backwards when the cam reaches the rest position is heavier than the weight of the cam portion moving forwards, generating a net counteracting centrifugal force which acts against the forward force of the bowstring and the unbending of bow limbs 14 and 16. Arrow 29 shows the direction of the net force generated when cams 20 and 22 reach their rest position.

The inventive counteracting weight utilized in the 2 cam embodiment of FIG. 1–3 results in the user feeling less shock and vibration in the arm holding the bow. In testing with cams of identical construction except for including the counteracting tungsten weight portion 28, it was unexpectedly found that addition of the tungsten weight increased the velocity of the arrow by 1–3 feet per second compared to the bow with identical cam construction, but which did not include tungsten weights in its cams.

By increasing the weight 28 in cam 22 relative to the weight 28 of cam 20 it was found that kick-back of the lower portion of bow 10 could be reduced.

Figure 6:
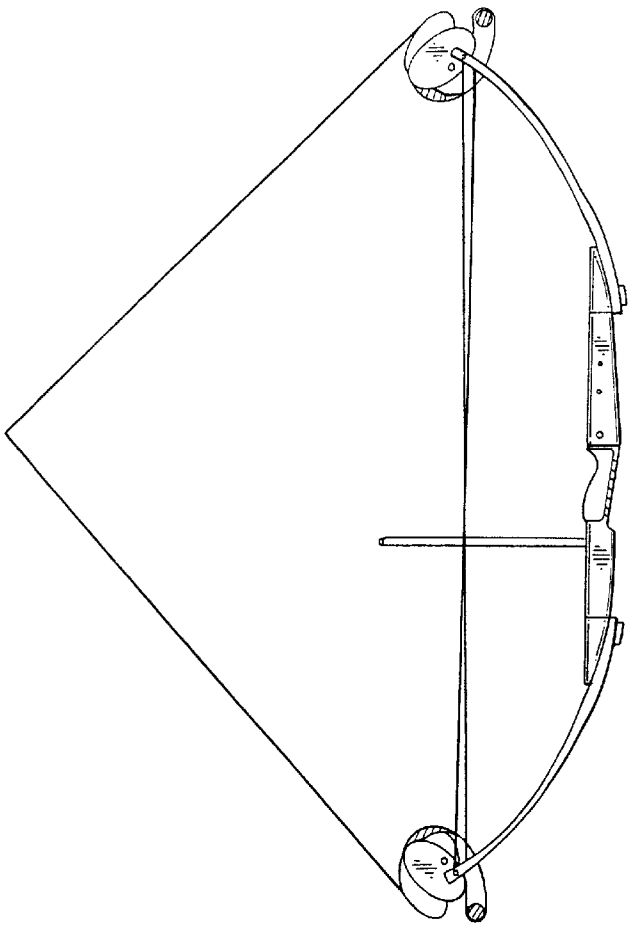
FIG. 6 shows a side view of a 2 cam bow with an alternate embodiment of the counteracting weight in the fully drawn position.
Figure 5:
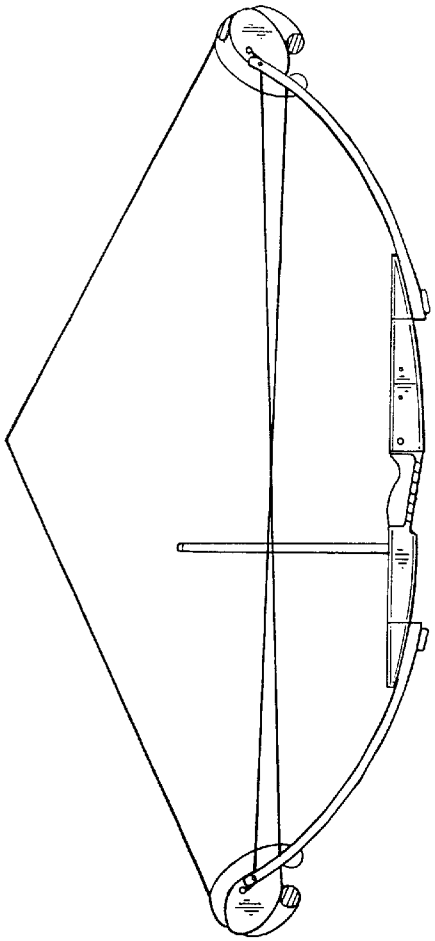
FIG. 5 shows a side view of a 2 cam bow with an alternate embodiment of the counteracting weight in a partially drawn position.
Figure 4:
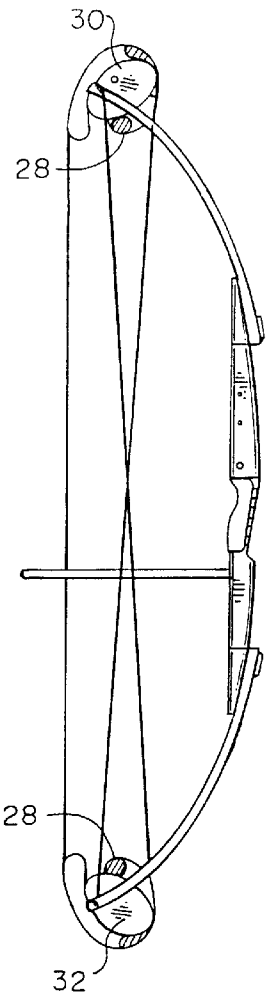
FIG. 4 shows a side view of a 2 cam bow with an alternate embodiment of the counteracting weight in the rest position.

FIGS. 4–6 show an alternate 2 cam embodiment in which weight 28 is positioned on a different portion of cams 30 and 32. Although not preferred, the embodiment of FIGS. 4–6 also reduces the forward force of bow 10, vibration and kick-back. The only critical feature of the invention is that a net force is generated in direction 29 by the cam when it reaches the rest position.

Figure 9:
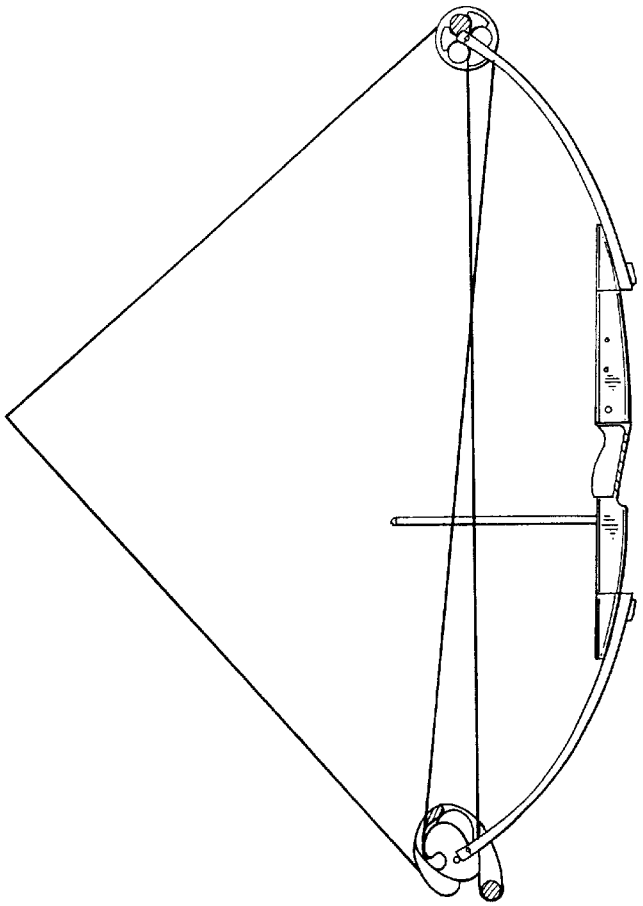
FIG. 9 shows a side view of a single cam bow with the preferred embodiment of the counteracting weight, shown in the fully drawn position.
Figure 8:
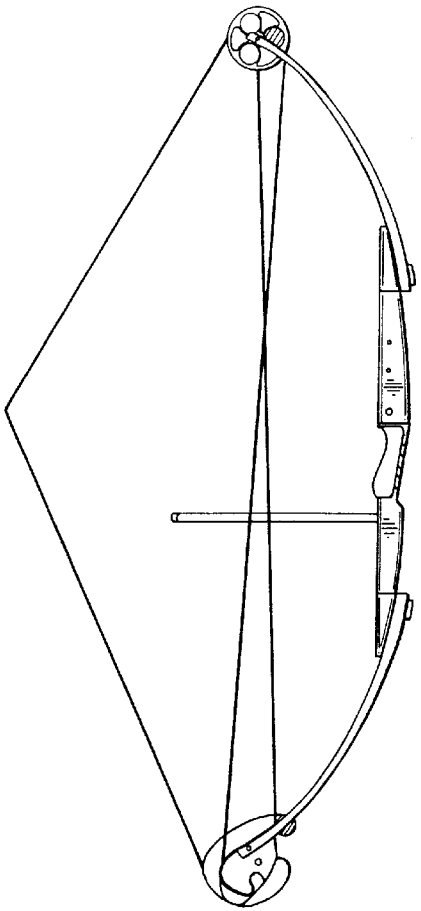
FIG. 8 shows a side view of a single cam bow with the preferred embodiment of the counteracting weight, shown in a partially drawn position.
Figure 7:
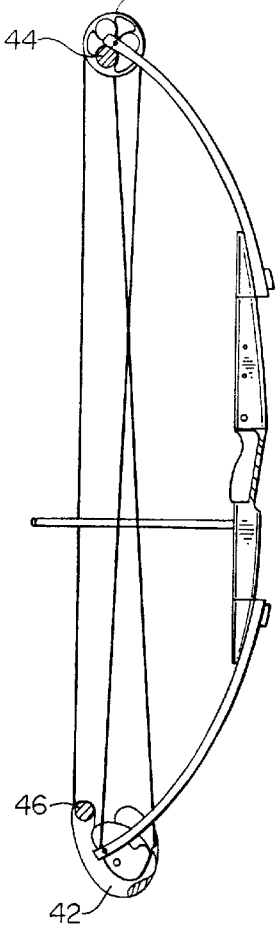
FIG. 7 shows a side view of a single cam bow with the preferred embodiment of the counteracting weight, shown in the rest position.

FIGS. 7–9 show a single cam embodiment of the inventive counteracting weight in which pulley 40 and cam 42 include counteracting tungsten weights 44 and 46. As in the 2 cam embodiment, the "heavy" portion of pulley 40 and cam 42 is moving backward relative to the bowstring when the bow reaches its rest position. This creates a net force in both pulley 40 and cam 42 which acts to counteract the forward force of bow 10.

As discussed above, the net force generated by cam 42 can be made greater than that generated by pulley 44 in order to reduce kick-back. It should be understood that this could be accomplished either by varying the relative weights, locations of the weights, or a combination of both. If desired, both the 2 cam and single cam embodiments may only include counteracting weights in the lower cam 22 or 42 to reduce kick-back while still reducing shock, vibration and increasing the velocity of the arrow.

Figure 12:
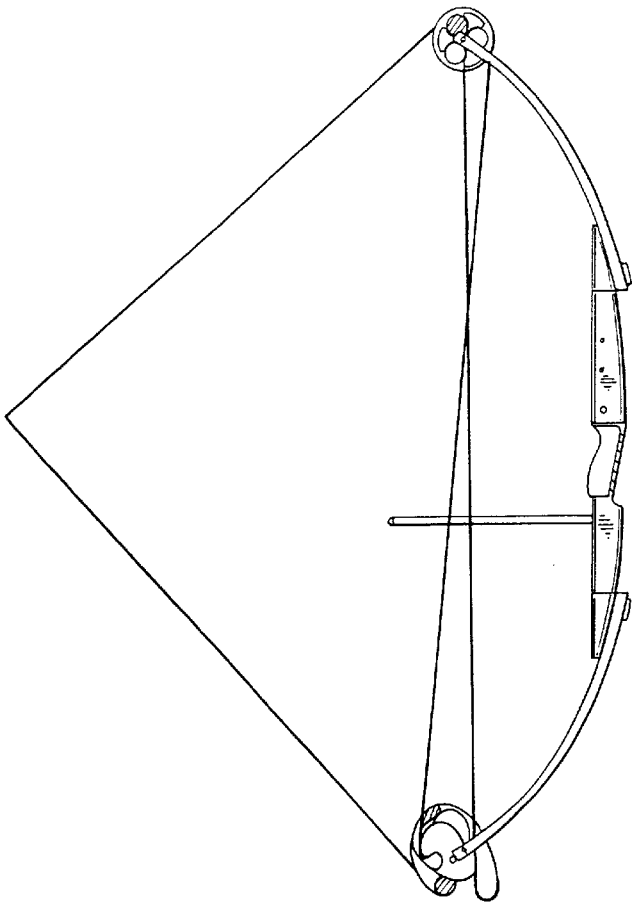
FIG. 12 shows a side view of a single cam bow with the alternate embodiment of the counteracting weight, shown in the fully drawn position.
Figure 11:
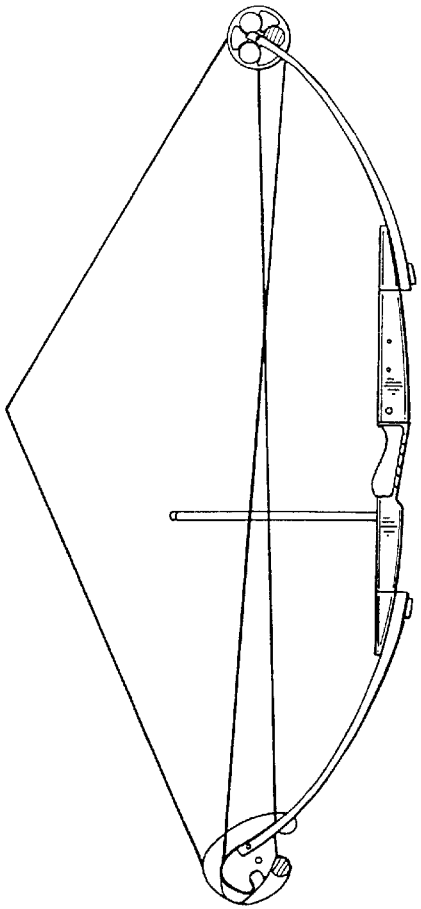
FIG. 11 shows a side view of a single cam bow with the alternate embodiment of the counteracting weight, shown in a partially drawn position.
Figure 10:
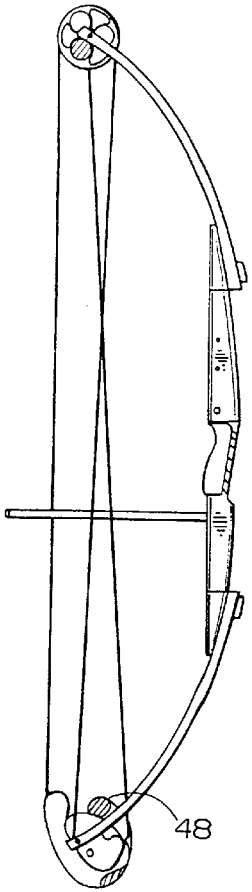
FIG. 10 shows a side view of a single cam bow with the alternate embodiment of the counteracting weight, shown in the rest position.

FIGS. 10–12 show a single cam embodiment in which weight 48 is located in the same place as weight 28 in cam 32 of FIG. 3.

Figure 13:
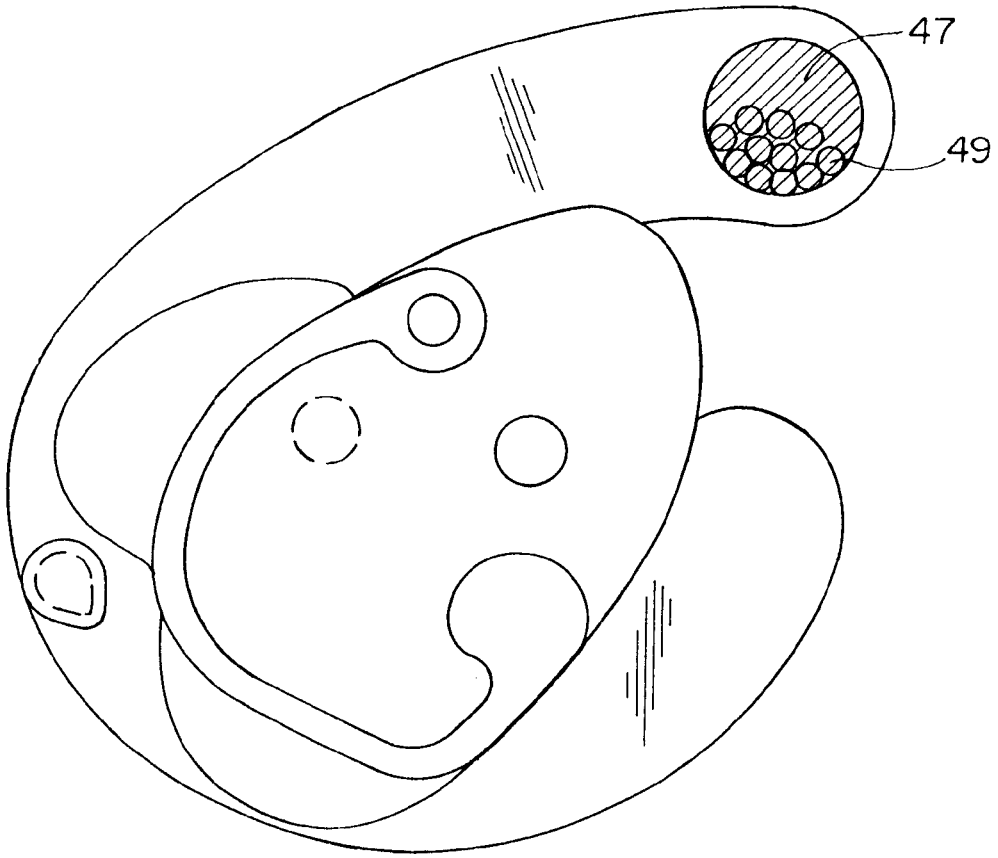
FIG. 13 shows an alternate embodiment of the inventive cam including a chamber containing tungsten ball bearings.

FIG. 13 shows an alternate embodiment of the inventive cam including a chamber 47 which includes a plurality of tungsten ball bearings 49 in a oil bath. The tungsten ball bearings 49 are moved by gravity to the opposite side of chamber 47 by the centrifugal force to generate the net counteracting force.

Figure 14:
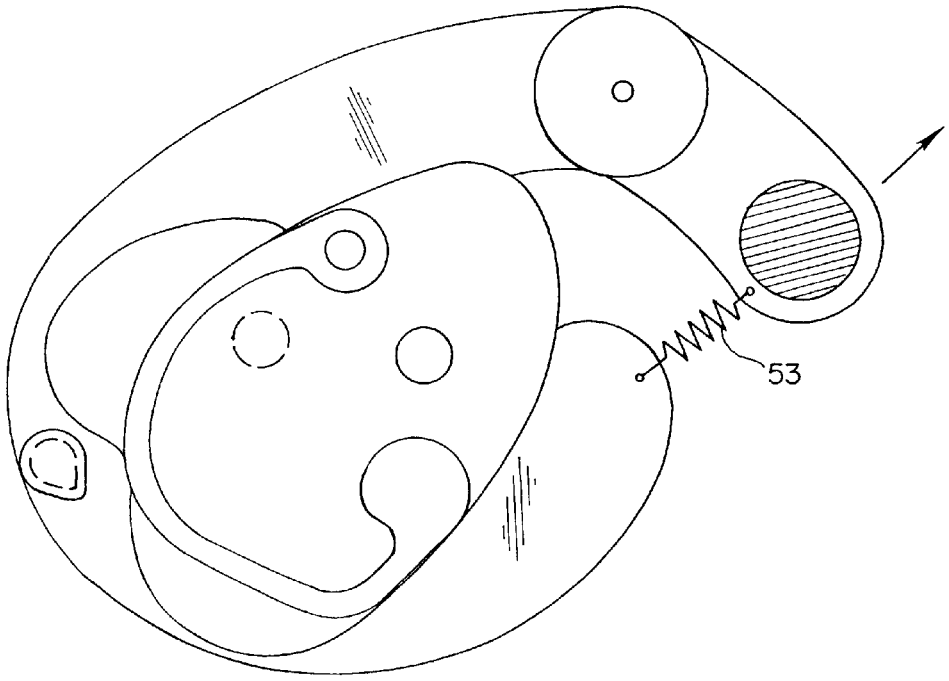
FIG. 14 shows a second alternate embodiment of the inventive cam including a movable arm connected to the cam by a spring with the spring in its compressed position.
Figure 15:
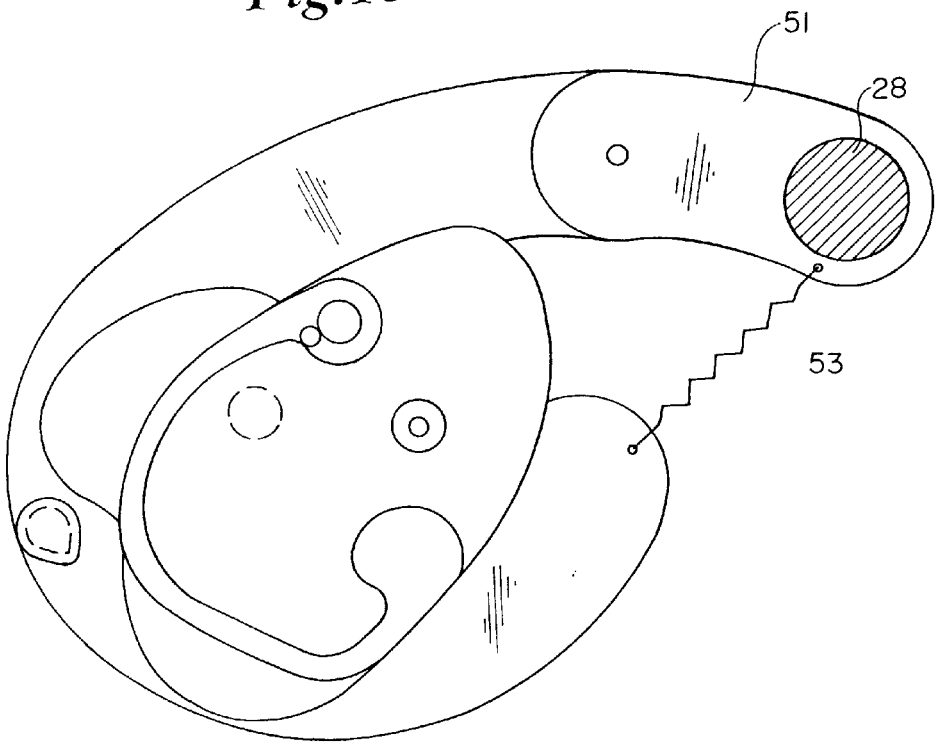
FIG. 15 shows a second alternate embodiment of the inventive cam including a movable arm connected to the cam by a spring with the spring in its uncompressed position.

FIGS. 14–15 show a second alternate embodiment of the inventive cam including a movable arm 51 containing weight 28, the movable arm connected to the cam body by spring 53. FIG. 14 shows movable arm 51 in its compressed position and FIG. 15 shows movable arm in its uncompressed position as the centrifugal force overcomes the tension of spring 53 to generate the net counteracting force.

Figure 16:
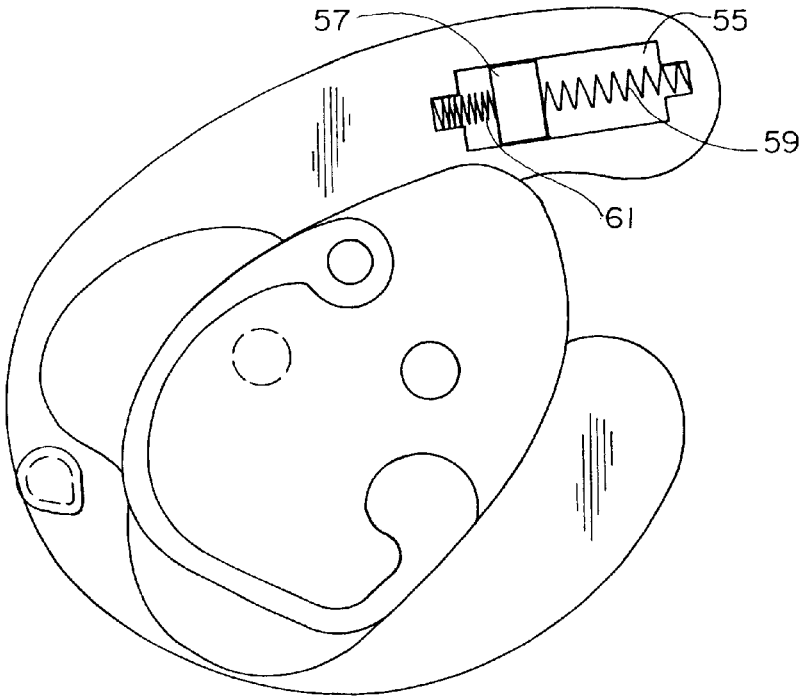
FIG. 16 shows a third alternate embodiment of the inventive cam including a chamber containing a weight spring mounted, shown in the drawn position.
Figure 17:
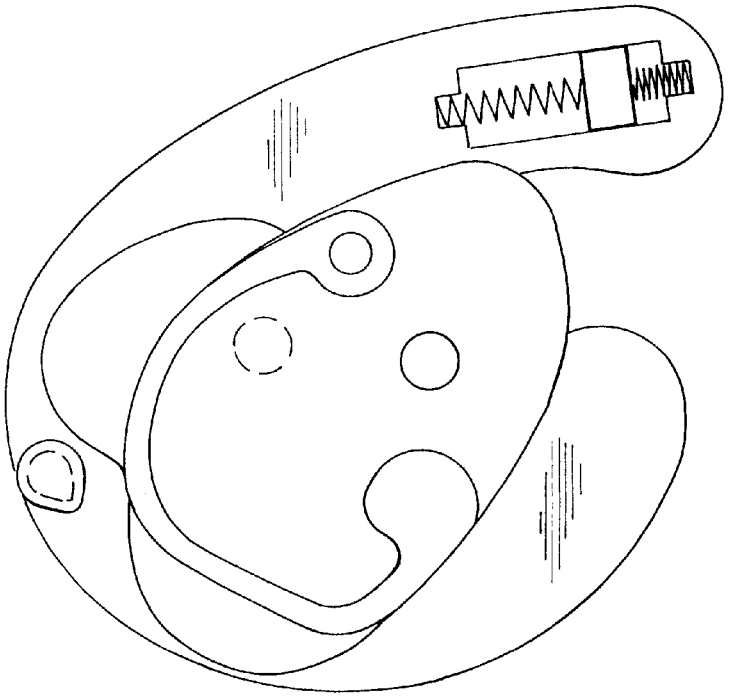
FIG. 17 shows a third alternate embodiment of the inventive cam including a chamber containing a weight spring mounted, shown in the rest position.

FIGS. 16 and 17 show a third alternate embodiment of the inventive cam including a chamber 55 containing a weight 57 spring mounted between springs 59 and 61. FIG. 16 shows the cam in the drawn position and FIG. 17 shows the cam as it rotates back to the rest position, causing weight 57 to move to generate the net counteracting force.

As can be seen from the embodiments of FIGS. 1–17, many different arrangements of a fixed weight or movable weight are possible. The only critical feature of the invention is that the weight generate a net counteracting centrifugal force acting against the forward force of the bow.

Figure 18:
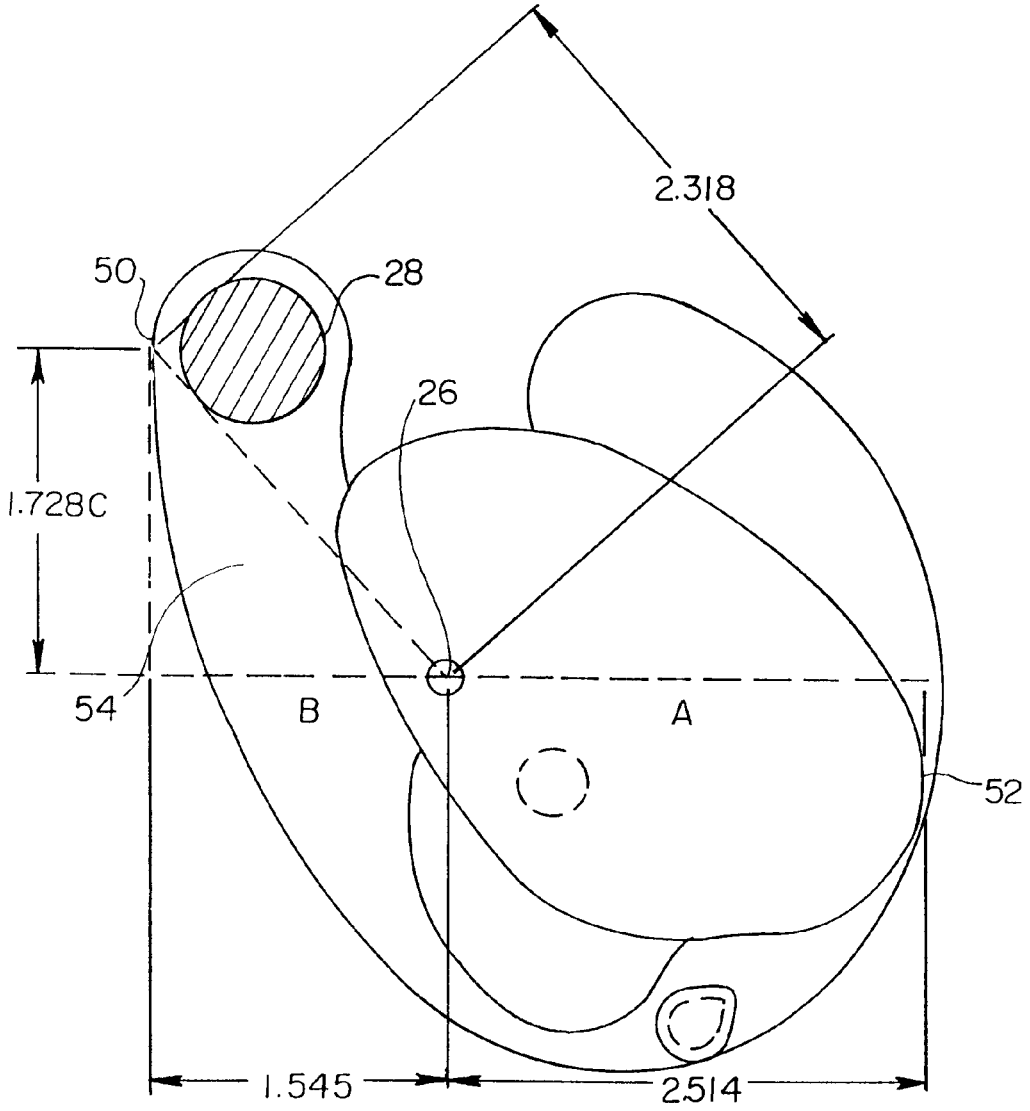
FIG. 18 shows a full size schematic view of the preferred embodiment of the inventive cam.

FIG. 18 shows a full size schematic view of the preferred embodiment of the inventive cam. Reference numeral 50 is the contact point at which the bowstring contacts the cam when the cam is at rest. Reference numeral 52 is the contact point at which the cable contacts the cam when the cam is at rest. As is well known in the art, the ratio of the perpendicular distance from the center of rotation of the cam to 52 (line segment A shown in FIG. 18) and the perpendicular distance from the center of rotation to 50 (line segment B shown in FIG. 18) is called the lever ratio:

The lever ratio of the cam of FIG. 18 is 2.514/1.545 or 1.627. In the prior art bows applicant is aware of the lever ratio of an eccentrically shaped cam is high, approximately 5. In other words the perpendicular distance of the bowstring contact point is much closer to the cam center of rotation than the perpendicular distance of the cable contact point.

In experimenting with different locations for counteracting weight 28, applicant extended the arm 54 which weight 28 is mounted in to increase the counteracting force generated. By extending arm 54 further inside the bow 10, the bowstring contact point 50 was moved further back toward the archer and further inside the bow toward the handle relative to the cam rotation point. Applicant has found many advantages to constructing a cam that keeps the sum of sides B and C of the right triangle defined by bowstring contact point 50, the perpendicular distance B and cam rotation point 26 to greater than 3 inches. This cam construction was found to store more energy in the first 3–5 inches of draw than prior art cams, in effect causing the force curve of the bow to peak approximately 1 inch earlier in the draw. So where a prior art bow might peak at 60 pounds at 18 inches, the bow using the inventive cam would peak at 60 pounds at 17 inches of draw, the draw distance being measured from the front of the handle as is well known in the art. This cam construction was found to increase the speed of the arrow by 2–6 feet per second as compared to prior art cams. The lower lever ratio also means that the bowstring is less taut at rest, resulting in a quieter shot, even while increasing the speed of the arrow. The effective string length is defined as the distance between the bowstring contact points of the two rotating members of a bow, either two cams or one cam and a pulley. By decreasing the effective string length the momentum of the string is better absorbed by the cam to decrease forward string whip.

Figure 19:
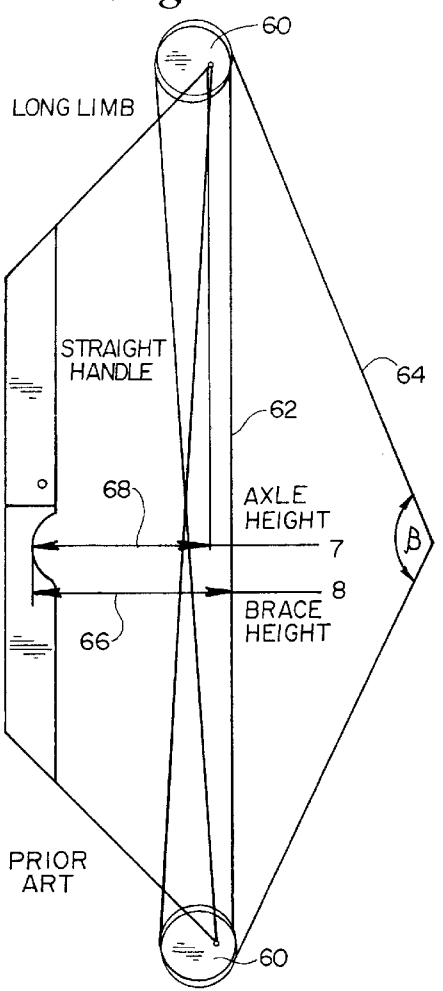
FIG. 19 shows a side view of a prior art bow in both a rest and partially drawn position.

The many advantages of the construction of the preferred embodiment will be further discussed in connection with FIGS. 19–21. FIG. 19 is a schematic view showing a prior art bow in both the rest and partially drawn positions. The bowstring is shown in the rest position at 62 and in the partially drawn position at 64.

The brace height of the bow is shown at 66 to be 8 inches, which is the distance from the inside of the handle to the bowstring at rest. The axle height of the bow is shown at 68 to be 7 inches, which is the distance from the handle to the line connecting the rotation points of cams 60.

Figure 21:
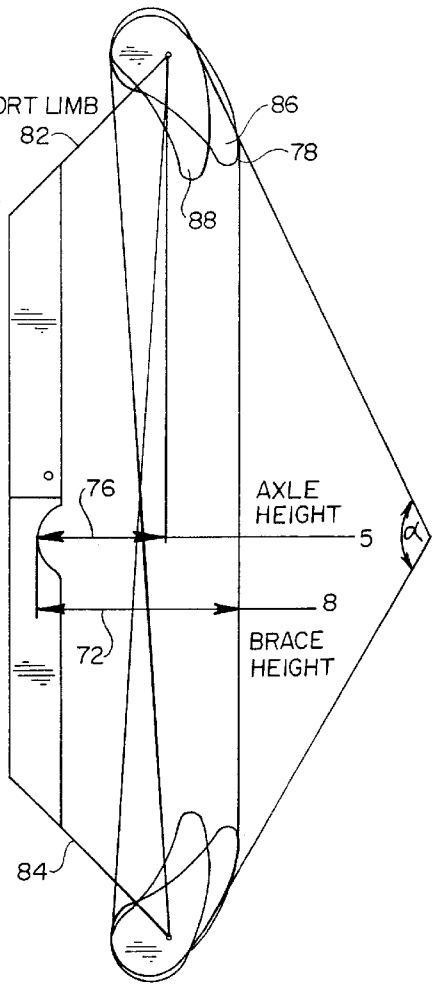
FIG. 21 shows a side view of a bow with shorter limbs and a schematic view of the inventive cams.
Figure 20:
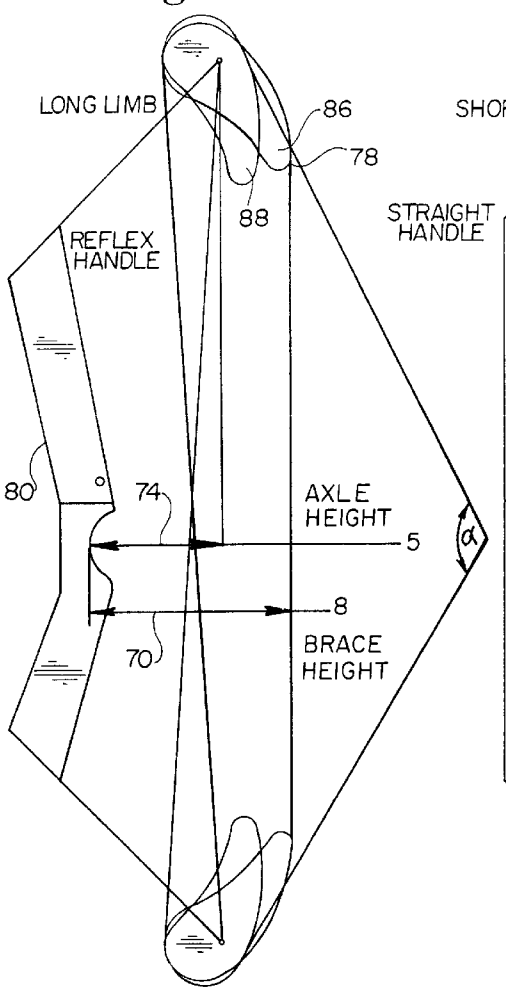
FIG. 20 shows a side view of a bow with a U-shaped reflex handle and a schematic view of the inventive cams.

FIGS. 20 and 21 both show bows with a brace height of 8 inches, and 72 respectively, and an axle height of 5 inches at 74 and 76 respectively. By moving the bowstring contact point back and inward to point 78, in order to maintain the same brace height of 8 inches the U-shaped reflex handle 80 of FIG. 20 must be used or the limbs 82 and 84 of FIG. 21 must be shortened. In either case the axel height of 5 inches results.

In FIGS. 20 and 21 the schematic view of the cam is shown in the rest position at 86 and in a partially drawn position at 88. Comparing FIGS. 20 and 21 to the prior art bow of FIG. 19 shows that the length of bowstring between the 2 bowstring contact points is shorter in FIGS. 20 and 21 compared to FIG. 19. Because of this shorter length, the angle a shown in FIGS. 20 and 21 is smaller than the angle β of FIG. 19 at the same partial draw distance. The smaller the angle a the more energy is stored in the bow. By moving the bowstring contact point back and inward and shortening the bowstring between the 2 cams the bow stores more energy in the first 4–5 inches of draw compared to FIG. 19. Applicant has found experimentally that because of the way the energy is stored and released by the inventive cam the velocity of the arrow is increased 2–6 feet per second as compared to prior art bows. Addition of the tungsten counteracting weight adds an additional 1–3 feet per second to the velocity of the arrow.

Another advantage of the inventive cam is that lowering the lever ratio to between 1–3 loosens the string at rest which lowers the vibration frequency of the string, resulting in a quieter shot. Shortening the string between the 2 bowstring contact points also permits the string less forward whip at the end of the shot, so the string is less likely to slap the wrist of the user. Another advantage is that as the cam rotates back to rest more string is taken up by the cam, which was found to absorb forward momentum of the string, which also reduces the forward whip of the string. These advantages were found where the effective string length was less than or equal to 95% of the axle to axle length of a single cam bow, or less than or equal to 92% of the axle to axle length of a dual cam bow.

This completes the description of the preferred and alternate embodiments of the invention. It is to be understood that even though numerous characteristics and advantages of the present invention have been set forth in the foregoing description, together with the details of the structure and function of the invention, the disclosure is illustrative only and changes may be made in detail, especially in matters of shape, size and arrangement of parts within the principals of the invention, to the full extent indicated by the broad, general meaning of the terms in which the appended claims are expressed. Those skilled in the art may recognize other equivalents to the specific embodiment described herein which are intended to be encompassed by the claims attached hereto.

What is claimed is:

1. An elliptically shaped cam for use with a compound bow comprising:

an elliptically shaped non-circular cam body having a rotation point for journaling the body to a bow limb, the body having a rest position and a drawn position in use with respect to the bow limb, the cam body being constructed and arranged such that the sum of the two sides of a right triangle defined by a bowstring contact point and the rotation point is greater than three inches.

2. The elliptically shaped cam of claim 1 wherein the cam has a lever ratio of between 1 and 3.

3. An elliptically shaped cam for use with a compound bow comprising:

an elliptically shaped cam body having a rotation point for journaling the body to a bow limb, the body having a rest position and a drawn position in use with respect to the bow limb, the cam body being constructed and arranged such that the sum of the two sides of a right triangle defined by a bowstring contact point and the rotation point is greater than three inches wherein the cam body has a lever ratio of approximately 1.6.

4. An elliptically shaped cam for use with a compound bow comprising:

an elliptically shaped cam body having a rotation point for journaling the body to a bow limb, the body having a rest position and a drawn position in use with respect to the bow limb, the cam body being constructed and arranged such that the sum of the two sides of a right triangle defined by a bowstring contact point and the rotation point is greater than three inches, the elliptically shaped cam body being mounted in a single cam bow, the cam constructed and arranged such that the effective bowstring length is less than or equal to 95% of the axle to axle length of the bow.

5. An elliptically shaped cam for use with a compound bow comprising:

an elliptically shaped cam body having a rotation point for journaling the body to a bow limb, the body having a rest position and a drawn position in use with respect to the bow limb, the cam body being constructed and arranged such that the sum of the two sides of a right triangle defined by a bowstring contact point and the rotation point is greater than three inches, the elliptically shaped cam body being mounted in a dual cam bow, the cams constructed and arranged such that the effective bowstring length is less than or equal to 92% of the axle to axle length of the bow.

6. An elliptically shaped cam for use with a compound bow comprising:

an elliptically shaped cam body having a rotation point for journaling the body to a bow limb, the body having a rest position and a drawn position in use with respect to the bow limb, the cam body being constructed and arranged such that the sum of the two sides of a right triangle defined by a bowstring contact point and the rotation point is greater than three inches, wherein the cam body includes an extension arm which extends a peripheral groove of the cam body.

7. The elliptically shaped cam of claim 6 wherein the extension arm includes a counteracting weight such that when the cam body returns to the rest position from the drawn position a net counteracting centrifugal force is generated acting against the forward force of the bow.

8. A compound bow comprising:

a pair of flexible resilient first and second bow limbs, each bow limb having an inner and outer end;

a handle connecting the inner ends of the bow limbs;

a rotating member attached to the outer end of each bow limb;

a bowstring arranged relative to the rotating members such that in use the bow has a rest position and a drawn position, wherein as the bow is moved to the drawn position by pulling the bowstring each rotating member rotates about a rotation point and the bow limbs are flexed to store energy, and wherein when the bowstring is released the rotating members rotate in the opposite direction and the bow limbs unflex, the movement of the bowstring and bow limbs creating a forward force on the bow when the bow returns to the rest position;

at least one of the rotating members being an elliptically shaped cam body, the cam body being constructed and arranged such that the sum of the two sides of a right triangle defined by the bowstring contact point and a rotation point is greater than three inches.

9. The compound bow of claim 8 the rotating members being constructed and arranged such that the bow reaches peak force within 3–5 inches of draw.

10. The compound bow of claim 8, the bow having a brace height of approximately 8 inches and the rotating members being mounted to the bow limbs such that the bow has an axle height of approximately 5 inches.

11. The compound bow of claim 10 wherein the handle is straight.

12. The compound bow of claim 10 wherein the handle is a reflex handle.

13. The compound bow of claim 8 wherein the cam body has a lever ratio of between 1 and 3, and the effective string length is less than or equal to 95% of the axle to axle length of the bow.

14. The compound bow of claim 13 wherein the cam includes a counteracting weight such that when the cam body returns to the rest position from the drawn position a net counteracting centrifugal force is generated acting against the forward force of the bow.

15. A cam for use with a compound bow, comprising:

a non-circular cam body having a rotation point for journaling the cam body to a bow limb, the cam body being constructed and arranged such that the rotation point and a bowstring contact point form the hypotenuse of a right triangle, and where the sum of the other two sides of the right triangle is greater than three inches.

16. The cam of claim 15 wherein the cam has a lever ratio between 1 and 3.

17. A cam for use with a compound bow, comprising:

a cam body having a rotation point for journaling the cam body to a bow limb, the cam body being constructed and arranged such that the rotation point and a bowstring contact point form the hypotenuse of a right triangle, and where the sum of the other two sides of the right triangle is greater than three inches, wherein the cam body has a lever ratio of approximately 1.6.

18. A cam for use with a compound bow, comprising:

a cam body having a rotation point for journaling the cam body to a bow limb, the cam body being constructed and arranged such that the rotation point and a bowstring contact point form the hypotenuse of a right triangle, and where the sum of the other two sides of the right triangle is greater than three inches, wherein the cam body includes a weighted extension arm and where the bowstring contact point lies on the weighted extension arm.

19. The cam of claim 18 wherein the weighted extension arm contains tungsten.

* * * * *